US007426359B2

(12) United States Patent
Tanda

(10) Patent No.: US 7,426,359 B2
(45) Date of Patent: Sep. 16, 2008

(54) COLOR IMAGE FORMING DEVICE HAVING A MOVABLE TONER SUPPLY MEMBER BEING DISPOSABLE IN A LASER LIGHT PATH

(75) Inventor: Tetsuo Tanda, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/163,774

(22) Filed: Oct. 31, 2005

(65) Prior Publication Data

US 2006/0093401 A1 May 4, 2006

(30) Foreign Application Priority Data

Oct. 29, 2004 (JP) ..... 2004-316782

(51) Int. Cl.
*G03G 15/01* (2006.01)

(52) U.S. Cl. ..... 399/227

(58) Field of Classification Search ..... 399/227, 399/258

See application file for complete search history.

(56) References Cited

U.S. PATENT DOCUMENTS 5,742,319 A * 4/1998 Fukunaga et al. ..... 347/138
7,274,899 B2 * 9/2007 Tomoe ..... 399/227
2006/0093402 A1 * 5/2006 Tomoe ..... 399/227
2006/0093403 A1 * 5/2006 Tanda ..... 399/227
2006/0093405 A1 * 5/2006 Tomoe et al. ..... 399/258
2006/0193659 A1 * 8/2006 Tanda ..... 399/258
2007/0048026 A1 * 3/2007 Tanabe ..... 399/258

FOREIGN PATENT DOCUMENTS

JP 62055679 A * 3/1987
JP S62/182768 A 8/1987
JP H10/198149 A 7/1998
JP 2001/134045 A 5/2001

* cited by examiner

*Primary Examiner*—Quana M Grainger
(74) *Attorney, Agent, or Firm*—Global IP Counselors, LLP

(57) ABSTRACT

An image forming device is disclosed, and includes a photosensitive drum, a laser unit for irradiating the photosensitive drum with laser light, developing units for developing the electrostatic latent image on the surface of the photosensitive drum, a toner container for containing toner to be supplied to the developing device, and toner supply pipes located so as to be movable between a supply position for supplying the developing units with the toner in the toner container, and a retracted position apart from the developing units. The toner supply pipes are located in a laser light path of the laser unit in the supply position, and are located so as to allow the laser light from the laser unit to reach the photosensitive drum in the retracted position.

10 Claims, 6 Drawing Sheets

COLOR IMAGE FORMING DEVICE HAVING A MOVABLE TONER SUPPLY MEMBER BEING DISPOSABLE IN A LASER LIGHT PATH

BACKGROUND OF THE INVENTION

1. Field of the Invention

The present invention relates to a color image forming device, and more particularly to a color image forming device in which toner is supplied to a developing device from a toner container located apart from the developing device.

2. Background Information

A color image forming device includes a plurality of developing units corresponding to a plurality of color toners. The developing units are arranged in several ways, such as in a lateral direction, around the photosensitive drum in a circumferential direction, and within a rotary frame located adjacent to the photosensitive drum.

A rotary developing device having a plurality of the developing units within the rotary frame is shown in Japanese Unexamined Patent Publication No. 62-182768. In this device, the rotary frame is rotatably located adjacent to the photosensitive drum and supports four color developing units. When the rotary frame is rotated, each of the developing units is sequentially placed opposite the photosensitive drum so as to develop each color.

In addition, other types of rotary developing devices have been proposed, for example, in Japanese Unexamined Patent Publication No. 10-198149 and Japanese Unexamined Patent Publication No. 2001-134045. Here, the rotary developing device includes a toner container located apart from the developing units supported by the rotary frame. In this device, the toner is supplied from the toner container to the developing units though a toner supply device including toner supply pipes.

When the toner container is located separate and apart from the developing device as mentioned above, it is also necessary to have a toner supply device. The toner supply device includes toner supply pipes as shown in Japanese Unexamined Patent Publication No. 10-198149, which should be located adjacent to the rotary developing device.

However, the photosensitive drum is located adjacent to the rotary developing device, and the laser light path, through which the laser light from the laser unit passes so as to be applied to the photosensitive drum, exists adjacent to the photosensitive drum. Accordingly, the toner supply pipes have to be located so as not to interfere with the light path, which means less flexibility in design. If the toner supply pipes are located so as to avoid the laser light path, the toner supply pipes may require additional installation space, thereby making it difficult to reduce the overall size of the image forming device.

It is an object of the present invention to reduce the size of an image forming device which includes a toner container apart from the developing device, by making effective use of the space for the toner supply device.

SUMMARY OF THE INVENTION

An image forming device according to a first aspect of the present invention comprises an image bearing member having a surface on which an electrostatic latent image is formed, a laser unit for irradiating the surface of the image bearing member with a laser light in accordance with image data, a developing device for developing the electrostatic latent image on the surface of the image bearing member, a toner container for storing toner to be supplied to the developing device, and a toner supply member located so as to be movable between a supply position for supplying the developing device with the toner in the toner container and a retracted position apart from the developing device. The toner supply member stands in a laser light path from the laser unit in the supply position, and is located so as to allow the laser light from the laser unit to reach the image bearing member in the retracted position.

In this device, the image bearing member is scanned and exposed by the laser light in accordance with the image data so that the electrostatic latent image is formed on the surface of the image bearing member. Then, the developing device develops the electrostatic latent image on the image bearing member. The developed image is transferred onto the sheet by the transferring member, and then the image on the sheet is fixed by the fixing device. The toner contained in the toner container is supplied to the developing device through the toner supply member.

It should be noted that the image forming operation and the toner supplying operation are not carried out at the same time. Namely, a space through which the laser path is formed during the image forming operation is an empty space during the toner supplying operation.

In the present invention, the toner supply member is movable between the supply position and the retracted position and the toner supply member is retracted to the retracted position so as not to interfere with the laser light path when the image forming operation is carried out. On the contrary, during the toner supplying operation, when the image forming operation is not carried out, the toner is supplied to the developing device by making use of a space where the laser light path is formed during the image forming operation, i.e., by moving the toner supply member to the supply position where the toner supply member stands in the laser light path.

In this device, the space is utilized as a laser light path during the image forming operation and is also utilized as a space for supplying toner during the toner supplying operation, so that it is not necessary to ensure a space for the toner supply device and a space for the laser light path separately. Consequently, the flexibility in design increases, and the device will be reduced in size.

According to a second aspect of the present invention, the image forming device according to the first aspect further comprises a transfer device for transferring the developed toner image onto a sheet. The image bearing member is a rotary photosensitive drum. The developing unit is located adjacent to the photosensitive drum and includes a rotary frame rotatable around an axis in parallel with a rotational axis of the photosensitive drum, and a plurality of developing units corresponding to a plurality of color toners and supported by the rotary frame. The toner supply member includes a plurality of toner supply pipes corresponding to the plurality of developing units respectively. The transfer device includes an intermediate transfer member located below the toner container and opposing to the photosensitive drum to which each of the color toners is sequentially transferred, and a secondary transfer member for transferring the image formed on the intermediate transfer member to the sheet.

The device includes a plurality of developing units located corresponding to the multiple color toners so as to form color images. The developing units are supported by the rotatable rotary frame and are sequentially opposed to the photosensitive drum and then the image in all color is collectively transferred to the sheet from the intermediate transfer member through the secondary transfer member.

In the developing units of the rotary developing system, the developing units are supplied with the toner through the corresponding toner supply pipes. In this case, the device is further reduced in size because the space is effectively utilized for locating the toner supply pipes therein.

According to a third aspect of the present invention, in the image forming device according to the second aspect, the laser unit is located above the photosensitive drum and on a first side of a direction that intersects with the rotational axis of the photosensitive drum, and the toner container is located above the photosensitive drum and on a second side opposite to the first side of the direction.

In this device, as the photosensitive drum, the developing device, the laser unit and the toner container are located as mentioned before, an empty space is ensured on the opposite side to the laser unit above the photosensitive drum. Accordingly, in the present invention, the toner container is located in the empty space, i.e., on a side opposite to a side of the laser unit and above the photosensitive drum.

As mentioned above, it is possible to reduce the rotary developing device in size and furthermore, a driving member of the rotary developing device in size and cost without increasing a size of the image forming device, because the toner container apart from the developing device is located in a dead space ensured by the arrangement of each of the components in the device.

According to a fourth aspect of the present invention, in the image forming device according to the second or third aspects, the toner supply member is located above the photosensitive drum and between the laser unit and the toner container.

The laser light path passes above the photosensitive drum and between the laser unit and the toner container in many cases. In the present invention, the toner supply member is located in the space through which the laser path passes so as to make effective use of the space.

According to a fifth aspect of the present invention, in the image forming device according to any of the first to fourth aspects, the device further comprises a discharge unit located above the laser unit to which the sheet is discharged.

In this device, the sheet on which the image is fixed is conveyed upward and is discharged to the discharge unit located above the laser unit. The area occupied by installation of the device can be reduced compared to when the discharge unit is provided outside of the body of the device, because the discharge unit is located above the laser unit.

According to a sixth aspect of the present invention, the image forming device according to any of the second to fifth aspects further comprises a sheet feeding cassette for storing sheets, and is located below the intermediate transfer member such that the sheet feeding cassette can be extracted toward the toner container side.

According to a seventh aspect of the present invention, the image forming device according to the sixth aspect further comprises a fixing device for fixing the transferred image on the sheet, and a sheet conveyance path for conveying the sheet in the sheet feeding cassette to the secondary transfer member and further to the fixing device from the secondary transfer member.

According to an eighth aspect of the present invention, the image forming device according to the seventh aspect further comprises a return conveyance path located vertically between the sheet conveyance path and the sheet feeding cassette, returning the sheet passed though the fixing device upstream of the secondary transfer member in the sheet conveyance path in a sheet conveyance direction.

In this device, when the image is formed on both surfaces of the sheet, the sheet is conveyed through the sheet conveyance path to form the image on a front surface of the sheet, and after passing through the fixing device, the sheet is returned by the return conveyance path upstream of the secondary transfer member in the sheet conveyance direction, and again is conveyed through the sheet conveyance path to form the image on a rear surface of the sheet.

In addition, the return conveyance path is located below the sheet conveyance path and above the sheet feeding cassette so that the return conveyance path makes it possible to prevent the area occupied by the installation of the device from increasing.

According to a ninth aspect of the present invention, the image forming device according to any of the sixth to eighth aspects further comprises a sheet tray onto which the sheet can be placed, the sheet tray being located below the toner container and above the sheet feeding cassette and on an outside of the toner container in the device.

According to a tenth aspect of the present invention, in the image forming device according to the sixth to ninth aspects, the toner container can be attached to and detached from the body of the device in the same direction as the direction in which the sheet feeding cassette can be pulled out.

In this device, the toner container and the sheet feeding cassette can be pulled out in the same direction so that the operability is improved.

Accordingly, in the present invention, in an image forming device including a toner container apart from the developing device, the size of the device is reduced by making effective use of a space in the device to locate the toner supply member therein.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
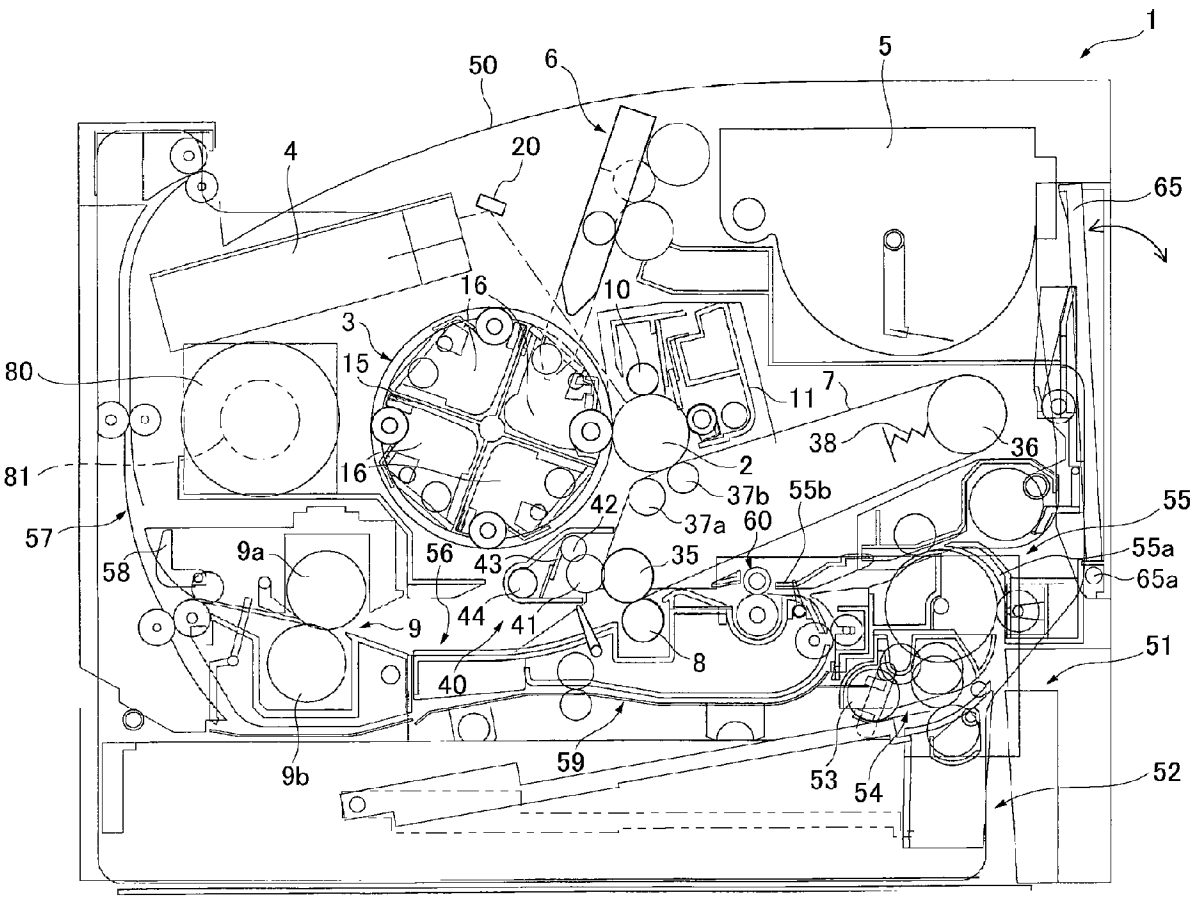
FIG. 1 is a schematic structural view of a color printer according to one embodiment of the present invention.

FIG. 1 shows a color printer 1 as a color image forming device according to an embodiment of the present invention. FIG. 1 is a view showing a frame format of the locations of each component, and thus the details of each portion are omitted.

Overall Structure

The color printer 1 is connected to a computer, for example, and is capable of printing a color image on a sheet (transfer medium) in accordance with image data sent from the computer. In this color printer 1, the right side of FIG. 1 is the side from which an operator operates the color printer 1. In the below description, the right side in FIG. 1 is referred to as the "front side" and the left side in FIG. 1 is referred to as the "rear side".

The color printer 1 includes a photosensitive drum 2, a rotary developing device 3, a laser unit 4, a toner container 5, a toner supply device 6, an intermediate transfer belt 7, a secondary transfer roller 8, and a fixing device 9.

Photosensitive Drum

The photosensitive drum 2 has a surface on which an electrostatic latent image is formed, and is rotatably mounted substantially in the center of the device. The rotational axis of the photosensitive drum 2 is located such that the axis extends in a lateral direction seen from the front side of the device, i.e., perpendicular to the plane of FIG. 1. On an upper portion of the photosensitive drum 2, a charge roller 10 for uniformly charging a surface of the photosensitive drum 2 is mounted. On a lateral side of the photosensitive drum 2, a drum cleaning device 11 is mounted for cleaning residual toner and other matter on the surface of the photosensitive drum 2.

Rotary Developing Device

The rotary developing device 3 is a device for developing an electrostatic latent image formed on the photosensitive drum 2 with each color toner. The rotary developing device 3 is located adjacent to the photosensitive drum 2 and has a center substantially corresponding to the center of the photosensitive drum 2 in a vertical direction. The rotary developing device 3 includes a rotary frame 15 and four developing units 16 corresponding to four color toners and supported by the rotary frame 15. The rotary frame 15 is a cylindrical member rotatable around an axis in parallel with the rotational axis of the photosensitive drum 2 and is driven by a drive mechanism including a motor and gears (not illustrated). In addition, the rotary frame 15 is formed with four compartments divided into quarters by partitions extending from the center of the rotational axis radially outward. Each of the compartments accommodates each of the developing units 16 corresponding to four color toners such as yellow, cyan, magenta, and black.

Figure 2:
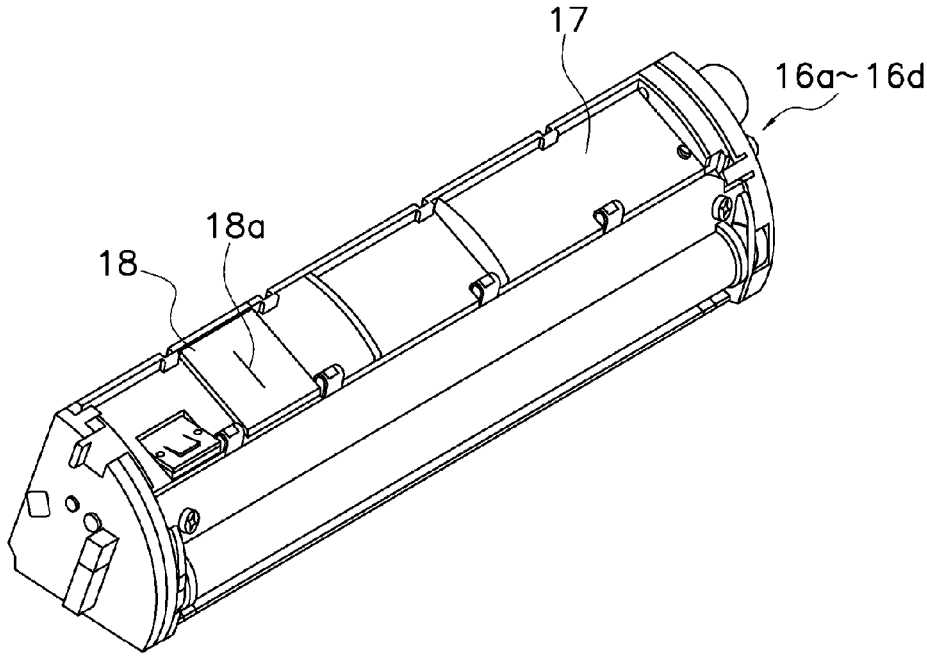
FIG. 2 is an external perspective view of the developing unit.

Each of the developing units 16 has a common structure and includes a developing roller capable of being located so as to be opposed to the photosensitive drum 2, and an agitation roller for agitating the toner. One of the four developing units 16 is shown in FIG. 2. In the present invention, a toner container (later described) is separately located apart from the developing units 16 so that the toner containment space of the developing units in the present embodiment is smaller. In other words, the developing units 16 are downsized compared to a developing device including an internal toner container. On an outer surface of a case 17 of the developing unit 16, a toner supply unit 18 is provided as shown in FIG. 2 so as to supply the toner from the toner container 5 into the developing unit 16. The toner supply unit 18 having an elastic member with a slit 18*a* is located at an opening of the case 17.

Laser Unit

The laser unit 4 is a device to scan and expose the photosensitive drum 2 in accordance with image data sent from the external computer and is located above the photosensitive drum 2 and on the rear side of the rotational axis of the rotary developing device 3. More specifically, the front end of the laser unit 4, the end from which laser light is emitted, is located immediately above the rotational axis of the rotary developing device 3, and an rear end is located below the upper end of the rotary developing device 3, with the whole of the laser unit 4 slanting downward toward the rear end. The inner construction of the laser unit 4 is common with that of a conventional laser unit, and includes a laser light source, a polygon mirror, a motor for driving the polygon mirror, and so on. In addition, on the front side of a laser light path from the laser unit 4, a reflective mirror 20 is provided so that the laser light emitted from the laser unit 4 is reflected by the reflective mirror 20, then passes on the front side of and above the rotary developing device 3, and is finally applied to the surface of the photosensitive drum 2 as shown in dotted lines in FIG. 1.

Toner Container

Figure 5:
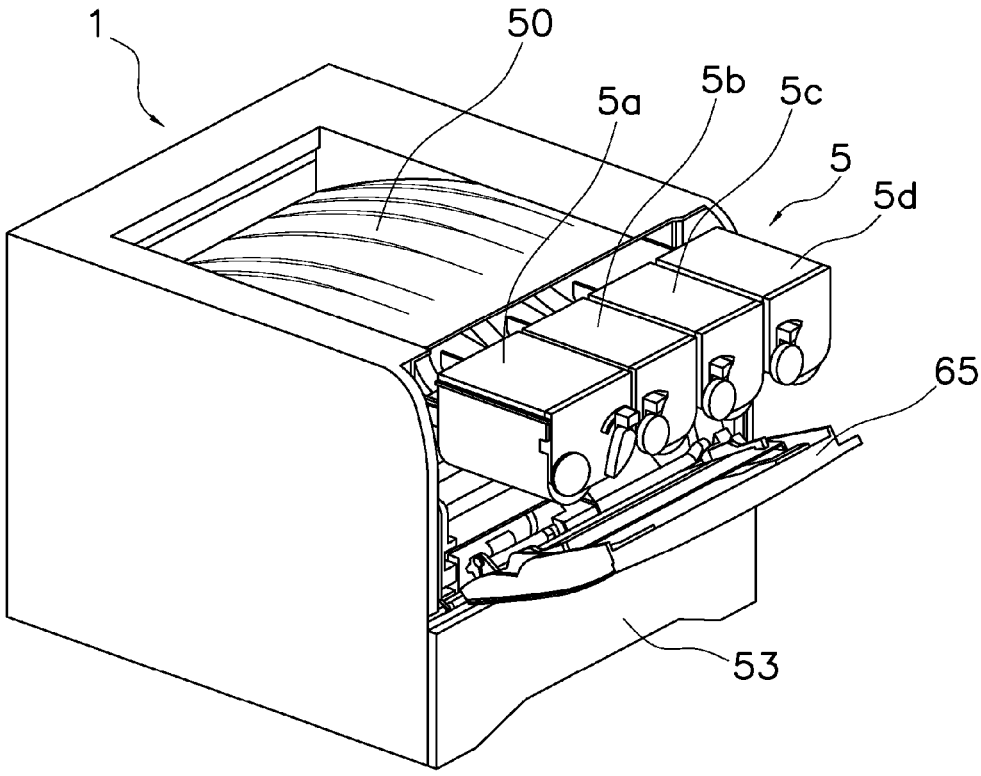
FIG. 5 is a perspective view of the color printer showing the toner containers extracted halfway.

The toner container 5 is a member for storing toner to be supplied to each of the developing units 16 of the rotary developing device 3, and is located above the photosensitive drum 2 and on a side opposite to the laser unit 4 (on a front side in the device). The toner container 5 includes, as shown in FIG. 5, four containers 5*a*, 5*b*, 5*c*, and 5*d* arranged in a lateral direction, i.e., in a direction perpendicular to the plane of FIG. 1, for storing color toner such as yellow, cyan, magenta, and black. The toner container 5 can be pulled out toward the front side of the device.

Toner Supply Device

Figure 3:
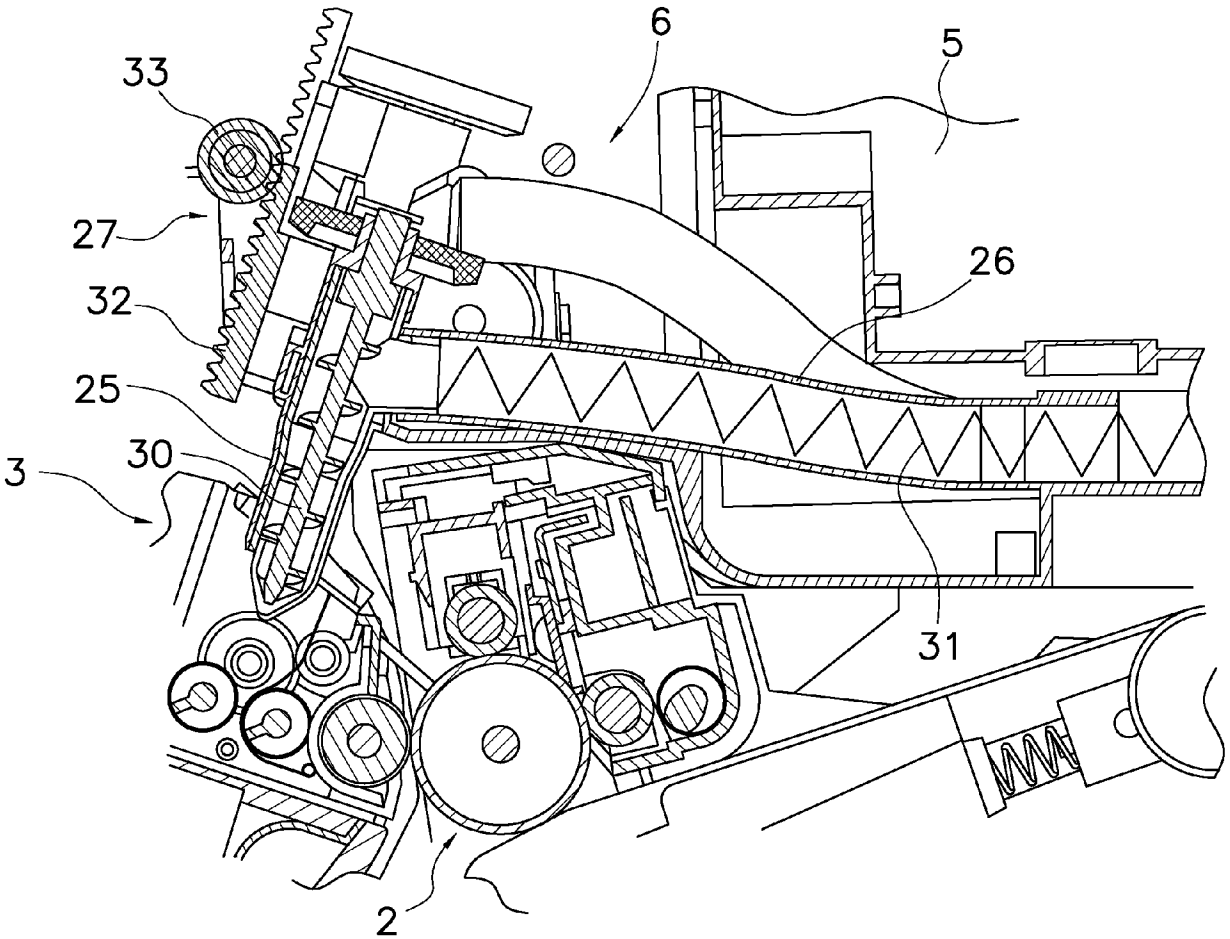
FIG. 3 is a detailed sectional view of the toner supply device.

The toner supply device 6 is a device to supply each of toners contained in the toner container 5 to corresponding developing units 16, and is located above the photosensitive drum 2 and in a space between the laser unit 4 and the toner container 5. The toner supply device 6 includes, as shown in FIG. 3, four toner supply pipes 25 that are vertically movable, four conveyance pipes 26 for connecting portions storing each color toner in the toner container 5 with corresponding toner supply pipes 25, and a drive mechanism 27 for moving the toner supply pipes 25 up and down.

Each toner supply pipe 25 extends vertically and is inclined such that an upper end is on the front side in the device and a lower end is on the rear side in the device. The toner supply pipe 25 has a tapered tip, which can advance into the inside of the developing unit 16 through the slit 18*a* of the toner supply unit 18 when the toner supply pipe 25 moves downward. Inside of the toner supply pipe 25, a spiral member 30 for conveying the toner is rotatably installed.

The conveyance pipe 26 is so flexible that the pipe 26 can follow vertical movements of the toner supply pipe 25. Inside of the conveyance pipe 26, a coil spring 31 is provided for conveying the toner to the toner supply pipe 25 within the conveyance pipe 26 when the coil spring 31 is rotated by a drive mechanism (not illustrated).

The drive mechanism 27 includes racks 32 provided on the outer circumference of the toner supply pipes 25 and extending in the axial direction of the pipes 25, and pinion gears 33 engaged with the racks 32. The pinion gears 33 are rotatably supported by a frame of the device and are driven by motors (not illustrated) and so on. The drive mechanism 27 makes it possible for the four toner supply pipes 25 to move between an upward retracted position shown in solid lines in FIG. 1, and a downward supply position shown in double-dashed lines, wherein the tip is inserted into the developing unit 16. As mentioned above, the laser light of the laser unit 4 passes above and on the front side of the rotary developing device 3. Namely, the laser light path and moving paths of the toner supply pipes 25 are crossed with each other so that although the laser light path is blocked by the toner supply pipe 25 when the toner supply pipe 25 is positioned in the supply position, the laser light path is not blocked by the toner supply pipes 25 when the toner supply pipes 25 is positioned in the retracted position.

The toner supply pipe 25 has a shutter mechanism which opens only when the toner supply pipe 25 is positioned in the supply position. More specifically, the toner supply pipe 25 has an overlapped structure of an inner cylinder and an outer cylinder, and tips of the cylinders are formed with an opening having a circumferential length. In addition, the outer cylinder is formed with a protruding portion engaged with a rotary cam having a spiral groove located around the outer cylinder. When the toner supply pipe 25 is in the upward retracted position, the openings of the inner cylinder and the outer cylinder do not overlap with each other (shutter closed) so that the toner does not leak outside. On the contrary, when the toner supply pipe 25 moves downward, the outer cylinder rotates by means of the protruding portion and the rotary cam, the tip of the toner supply pipe 25 is inserted into the developing unit 16. Then, when the toner supply pipe 25 reaches the supply position, the openings of the inner cylinder and the outer cylinder overlap with each other (shutter opened) so that the inside toner is supplied to the inside of the developing unit 16 from the openings.

Intermediate Transfer Belt

The intermediate transfer belt 7 is a member on which the toner images in each color formed on the photosensitive drum 2 are sequentially transferred and is located below the photosensitive drum 2 and the toner container 5. The intermediate transfer belt 7 is looped over a driving roller 35 and a follower roller 36 located in the opposite directions. A portion of the transfer belt 7 facing the photosensitive drum 2 is constructed so as to be brought into contact with the photosensitive drum 2 by a pair of primary transfer rollers 37*a* and 37*b*.

The arrangement of the above-mentioned components will be described in more detail. The driving roller 35 is located immediately below contact portions of the photosensitive drum 2 and the rotary developing device 3, and the center is positioned below the lower end of the rotary developing device 3. The driving roller 35 is driven by a driving unit including a motor and gears (not illustrated). The follower roller 36 is located adjacent to a bottom of the toner container 5 and on the front side in the device, and its position in a vertical direction is substantially the same with a position of the photosensitive drum 2. The follower roller 36 is urged by a spring 38 in the direction opposite to the driving roller 35 so that the intermediate transfer belt 7 is tensioned. In addition, the primary transfer rollers 37*a* and 37*b* are located adjacent to each other below the photosensitive drum 2 so that a certain range of the transfer belt 7 is in contact with the photosensitive drum 2.

A belt cleaning device 40 for cleaning the transfer belt 7 is located on the rear side of the driving roller 35 and below the rotary developing device 3. The belt cleaning device 40 includes a fur brush 41 located in a position facing the driving roller 35 and in sliding contact with the surface of the transfer belt 7, a cleaning roller 42 located above the fur brush 41 so as to be in contact with the fur brush 41, a blade 43 having a tip located so as to be in contact with a surface of the cleaning roller 42, and a recovery spiral 44 located below the blade 43 side by side.

In this cleaning device 40, matter attached to the intermediate transfer belt 7 is scraped off by the fur brush 41, and then is recovered to the cleaning roller 42. The matter is then scraped off by the blade 43 from the surface of the cleaning roller 42 and recovered to a recovery unit (not illustrated) by the recovery spiral 44.

Secondary Transfer Roller

The secondary transfer roller 8 is a member to transfer the image transferred on the intermediate transfer belt 7 onto the conveyed sheet and is located below the driving roller 35 and facing the driving roller 35. Bias voltage is applied to the secondary transfer roller 8 by an energizing means (not illustrated) so as to transfer the image to the sheet.

Fixing Device

The fixing device 9 is a device to fix the toner image transferred onto the sheet by fusion and is located below the rotary developing device 3 and on the rear side in the device. The fixing device 9 includes a heating roller 9*a* having a built-in heater and a pressure roller 9*b* pressing against the heating roller 9*a* for pinching the sheet therebetween so as to convey the sheet.

Discharge Unit

In the printer 1, the discharge unit 50 is provided on a surface of an upper portion of the device, i.e., above the laser unit 4, the toner supply device 6, and the toner container 5, and sheets on which images have been formed are discharged thereto. The discharge unit 50 consists of a curved portion gradually increasing the height from the lowest portion on the laser unit 4 side (on the rear side in the device) to the other side on the toner container 5 side (on the front side in the device), and a flat portion continuous with the curved portion located above the toner container 5.

Sheet Feeding Unit

At the bottom of the device, the sheet feeding unit 51 for storing the sheets and launching out the sheets is provided. The sheet feeding unit 51 includes a sheet feeding cassette 52 having a stack plate on which the sheets are stacked, a forward feeding roller 53 and a multiple feeding prevention mechanism 54 for dispatching individual sheets into the conveyance path. The sheet feeding cassette 52 can be pulled out toward the front side of the device.

Conveyance Mechanism

The conveyance mechanism for conveying sheets is located between the sheet feeding unit 51 and the discharge unit 50. The conveyance mechanism includes a first conveyance path 55 from the sheet feeding unit 51 to the secondary transfer roller 8, a second conveyance path 56 from the secondary transfer roller 8 to the fixing device 9, and a third conveyance path 57 from the fixing device 9 to the discharge unit 50. At an exit of the fixing device 9, a branching claw 58 is provided, and a return conveyance path 59 is provided between the branching claw 58 and a middle of the first conveyance path 55 for returning the sheet to the first conveyance path 55.

The first conveyance path 55 includes a curved path 55*a* for reversing the conveyance direction as well as conveying the sheet sent out from the sheet feeding cassette 52 upward, and a straight path 55*b* extending from the curved path 55*a* to the secondary transfer roller 8. These conveyance paths are composed of guide plates and pairs of rollers for guiding the sheet as well as conveying them, and include sensors installed at places for sensing the sheet. In addition, a pair of registration rollers 60 is provided in the straight path 55*b* for controlling conveyance timing of the sheet.

The second conveyance path 56 extends in a rectilinear direction and is composed of guide plates and pairs of rollers for guiding the sheets as well as conveying them, and includes sensors installed at places for sensing the sheet.

The third conveyance path 57 includes a vertical conveyance path formed downstream of the branching claw 58 in the conveyance direction. Namely, the sheet is conveyed upward in the vertical direction after passing the branching claw 58 and is discharged to the discharge unit 50. The third conveyance path 57 is also composed of guide plates and pairs of rollers for guiding the sheets as well as conveying them.

The return conveyance path 59 is a conveyance path which branches off downward from the third conveyance path 57 at a place where the branching claw 58 is mounted and extends below the fixing device 9, the second conveyance path 56, the secondary transfer roller 8 and the pair of the registration rollers 60, and then extends upward so as to join upstream of the pair of the registration rollers 60 in the first conveyance path 55 in the conveyance direction. Namely, the return conveyance path 59 is a conveyance path located between the sheet feeding cassette 52 and straight path 55*b* of the first conveyance path 55 as well as the second conveyance path 56. The path 59 returns the sheet passed through the fixing device 9 upstream of the pair of the registration rollers 60, which is located upstream of the secondary transfer roller 8. The return conveyance path 59 is also composed of guide plates and pairs of rollers for guiding the sheets as well as conveying them, and includes sensors installed at places for sensing the sheets.

Sheet Feeding Tray

Below the toner container 5 and above the sheet feeding cassette 52, the sheet feeding tray 65 is provided so as to form a lateral wall on the front side of the device. The sheet feeding tray 65 has a lower end pivotably supported in the vicinity of the curved path 55*a* of the first conveyance path 55 such that the sheet feeding tray 65 can take an open position and a closed position. The upper end of the sheet feeding tray 65 can be reclined toward the front side of the device around a rotation center 65*a* in the lower end. Accordingly, when the sheet feeding tray 65 is opened, it is possible to put the sheet on the sheet feeding tray 65 and supply the curved path 55*a* of the first conveyance path 55 with the sheets.

Image Forming Operation

Next, the image forming operation will be explained in a simplified manner. First, when the power is applied to the color printer 1, a variety of parameters are initialized and initialization is executed such as setting a temperature of the fixing device. Then, when the image data from the computer connected to this printer is inputted and an instruction to start printing is given, the image forming operation is carried out as follows. It should be noted that during the image forming operation the toner supply pipe 25 is moved to the upward retracted position so that the laser path is not blocked by the toner supply pipe 25.

First, the charge roller 10 charges the photosensitive drum 2. After that, the photosensitive drum 2 is scanned and exposed by the laser unit 4 in accordance with the image data so that the electrostatic latent image is formed on the photosensitive drum 2. Next, the rotary developing device 3 is rotated and the developing unit 16 whose color is designated is opposed to the photosensitive drum 2. In this state, the electrostatic latent image on the photosensitive drum 2 is developed with the designated toner color. The developed image is transferred to the intermediate transfer belt 7. The above-mentioned operation is sequentially carried out color by color so that the full color image is formed on the intermediate transfer belt 7. It should be noted that residual toner on the photosensitive drum 2 is cleaned by the drum cleaning device 11 and is discarded into a discarded toner container (not illustrated).

In the sheet feeding unit 51, a sheet is taken out from the sheet feeding cassette 52 by the forward feeding roller 53 and multiple feeding prevention mechanism 54, and is conveyed to the pair of the registration rollers 60 through the first conveyance path 55. Then, the sheet is conveyed from the pair of the registration rollers 60 to the intermediate transfer belt 7 with timing of image forming thereon and guided to the secondary transfer roller 8. The secondary transfer roller 8 is in contact with the intermediate transfer belt 7 and the full color image formed on the intermediate transfer belt 7 is transferred to the sheet by transfer bias applied to the secondary transfer roller 8. The sheet is guided to the fixing device 9 through the second conveyance path 56, and the image is fixed to the sheet by heat and pressure in the fixing device 9. In the case of one-side printing, the sheet is guided to the third conveyance path 57 by means of the branching claw 58, and then is discharged to the discharge unit 50.

In the case of double-side printing, after fixation in the fixing device 9, the sheet is guided by the branching claw 58 toward a side of the return conveyance path 59 and is returned to the first conveyance path 55 again. The sheet is temporarily stopped by the pair of the registration rollers 60. The sheet is sent with precise timing toward the secondary transfer roller 8 after the rear side image is formed on the intermediate transfer belt 7 in the same operation mentioned before. After that, the same operation is carried out and the sheet is guided toward the third conveyance path 57 by means of the branching claw 58 and is discharged to the discharge unit 50.

Toner Supplying Operation

When the toner is supplied to the developing units 16, the rotary developing device 3 is rotated such that the developing unit 16 to which the toner will be supplied is positioned in the supply position as shown in FIG. 1. The rotary developing device 3 is locked so as not to rotate in this state. Next, the toner supply pipe 25 is moved downward to the supply position. More specifically, the motor (not illustrated) drives the pinion gear 33 with the gears so that the toner supply pipe 25 to which the rack 32 is fixed is moved downward. Meanwhile, the toner is supplied to the toner supply pipe 25 from the toner container 5 through the conveyance pipe 26. The tip of the toner supply pipe 25 advances through the slit 18*a* as a toner supply opening into the developing unit 16. During the downward movement of the toner supply pipe 25, the outer cylinder rotates relative to the inner cylinder. Upon the entry of the tip of the toner supply pipe 25 into the developing unit 16, the openings of the outer cylinder and the inner cylinder correspond to each other. In other words, the shutter mechanism is opened so that the toner inside of the toner supply pipe 25 is supplied into the developing unit 16.

It should be noted that although the toner supply pipe 25 blocks the laser light path from the laser unit 4 to the photosensitive drum 2 when toner supply pipe 25 is positioned in the supply position, it is not a cause for concern because the toner supplying operation by the toner supply pipe 25 and the image forming operation are not carried out simultaneously.

It is possible to reduce the overall size of the printer, because the toner supply device 6 is located by making effective use of a space between the laser unit 4 and the toner container 5. More specifically, the space between the laser unit 4 and the toner container 5 corresponds, in this embodiment, to the laser light path so that the components such as toner supply pipes can not be located therein usually. In this embodiment, however, focusing attention on a fact that the toner supplying operation and the image forming operation are not carried out simultaneously, the toner supply pipe 25 is moved to the retracted position so as not to hinder the image forming operation during the image forming operation and is moved to the supply position where the toner supply pipe 25 blocks the laser light path, i.e., making use of a part of the laser light path. Accordingly, the space is effectively utilized and the printer is reduced in size.

As is clear from FIG. 1, if the photosensitive drum 2, the rotary developing device 3, the laser unit 4, the intermediate transfer belt 7 and the conveyance mechanism are disposed as in the present embodiment, an empty space is ensured above the photosensitive drum 2 and on the front side in the device, i.e., on the front side of the laser unit 4. In the present embodiment, in the empty space, i.e., the dead space, the toner container 5 separately located apart from the developing units 16 is provided so that it is possible to make effective use of the space in the device. Accordingly, in the device wherein the toner container is provided apart from the developing units for reducing the rotary developing device in size in the printer employing the rotary developing system, growing of the whole size of the printer is avoided.

It is possible to reduce the area occupied due to the installation of the printer, because the discharge unit 50 is located on the upper portion of the printer, the sheet feeding cassette 52 is located at the bottom of the device, and the return conveyance path 59 is located between the sheet conveyance path and the sheet feeding cassette 52.

Figure 4:
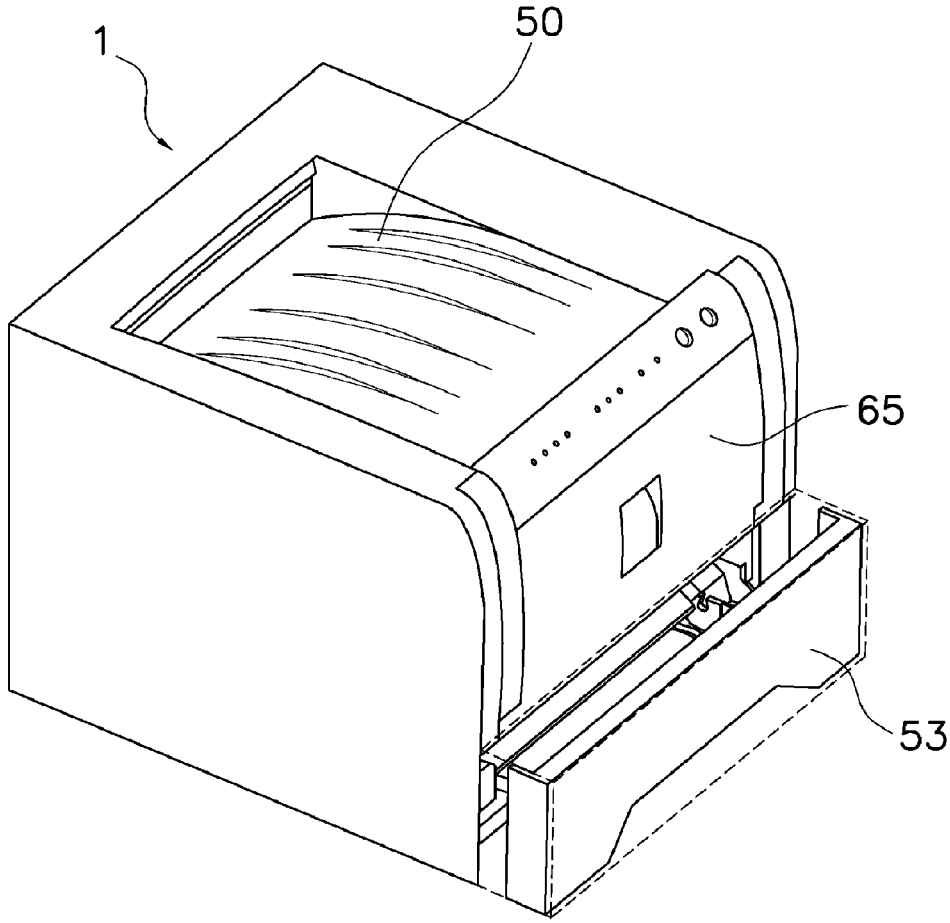
FIG. 4 is a perspective view of the color printer showing the sheet feeding cassette extracted halfway.
Figure 6:
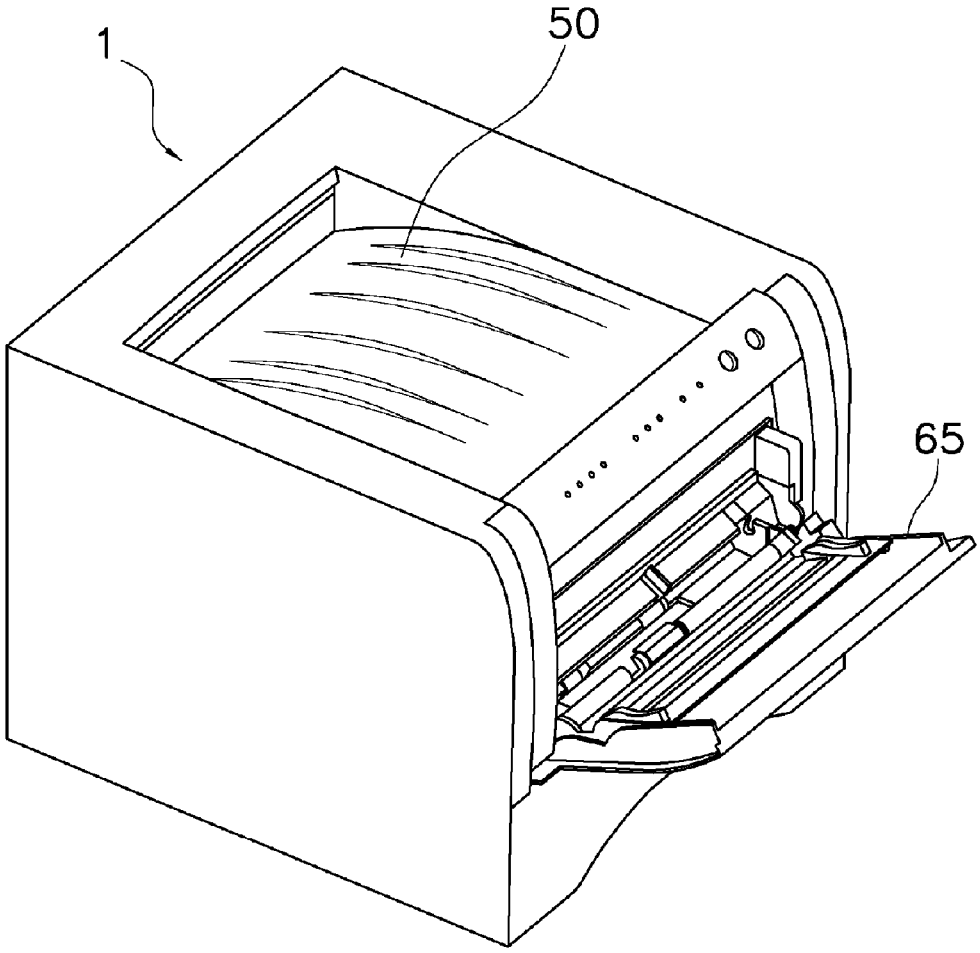
FIG. 6 is perspective view of the color printer showing the sheet feeding tray opened.

FIGS. 4 to 6 show the sheet feeding cassette 52 extracted halfway, the toner container 5 removed halfway, and the sheet feeding tray 65 opened, respectively. As clear from the figures, sides from which the sheet feeding cassette 52, the toner container 5 and the sheet feeding tray 65 are operated are the same, i.e., on the front side of the device so that the workability is improved.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2004-316782. The entire disclosure of Japanese Patent Application No. 2004-316782 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An image forming device comprising:

an image bearing member having a surface, an electrostatic latent image being formed thereon;

a laser unit, the laser unit irradiating the surface of the image bearing member with a laser light in accordance with image data;

a developing device, the developing device developing the electrostatic latent image on the surface of the image bearing member;

a toner container, the toner container storing toner to be supplied to the developing device; and a toner supply member located so as to be movable between a supply position supplying the developing device with the toner in the toner container, and a retracted position being apart from the developing device, the toner supply member being disposed in a laser light path from the laser unit in the supply position, and allowing the laser light from the laser unit to reach the image bearing member in the retracted position, the toner supply member being positioned at the supply position during the time of supplying toner when an image is not being formed, and being positioned at the retracted position when an image is being formed.

2. An image forming device according to claim 1, further comprising a transfer device that transfers the developed toner image onto a transfer medium, and wherein the image bearing member is a rotary photosensitive drum, the developing device is located adjacent to the photosensitive drum and includes a rotary frame rotatable around an axis in parallel with a rotational axis of the photosensitive drum, and a plurality of developing units corresponding to a plurality of color toners and supported by the rotary frame, the toner supply member includes a plurality of toner supply pipes corresponding to the plurality of developing units respectively, and the transfer device includes an intermediate transfer member to which each of the color toners is sequentially transferred and located below the toner container and opposing to the photosensitive drum, and a secondary transfer member that transfers the image formed on the intermediate transfer member to the transfer medium.

3. An image forming device according to claim 2, wherein the laser unit is located above the photosensitive drum and on a first side of a direction that intersects with the rotational axis of the photosensitive drum, and the toner container is located above the photosensitive drum and on a second side opposite to the first side of the direction.

4. An image forming device according to claim 2, wherein the toner supply member is located above the photosensitive drum and between the laser unit and the toner container.

5. An image forming device according to claim 1, further comprising a discharge unit located above the laser unit and to which the transfer medium is discharged after image formation.

6. An image forming device according to claim 2, further comprising a sheet feeding cassette that stores transfer media, the sheet feeding cassette located below the intermediate transfer member such that the sheet feeding cassette is extractable toward the toner container side.

7. An image forming device according to claim 6, further comprising a fixing device for fixing the transferred image on the transfer medium, and a sheet conveyance path configured to convey the transfer medium in the sheet feeding cassette to the secondary transfer member, and further to the fixing device from the secondary transfer member.

8. An image forming device according to claim 7, further comprising a return conveyance path located vertically between the sheet conveyance path and the sheet feeding cassette, the return conveyance path returning transfer media that have passed though the fixing device upstream of the secondary transfer member in the sheet conveyance path in a sheet conveyance direction.

9. An image forming device according to claim 6, further comprising a sheet tray onto which transfer media are be placed, the sheet tray located below the toner container and above the sheet feeding cassette and on the outside of the toner container in the device.

10. An image forming device according to claim 6, wherein the toner container is attachable to and detachable from a body of the device in the same direction as the direction in which the sheet feeding cassette is pulled out.

* * * * *